US007845913B2

(12) United States Patent
Stiles, Jr. et al.

(10) Patent No.: US 7,845,913 B2
(45) Date of Patent: Dec. 7, 2010

(54) FLOW CONTROL

(75) Inventors: Robert W. Stiles, Jr., Cary, NC (US); Lars Hoffmann Berthelsen, Kolding (DK); Peter Westermann-Rasmussen, Soenderborg (DK); Gert Kjaer, Soenderborg (DK); Florin Lungeanu, Egernsund (DK)

(73) Assignee: Pentair Water Pool and Spa, Inc., Sanford, NC (US)

( * ) Notice: Subject to any disclaimer, the term of this patent is extended or adjusted under 35 U.S.C. 154(b) by 0 days.

(21) Appl. No.: 11/609,101

(22) Filed: Dec. 11, 2006

(65) Prior Publication Data

US 2007/0154320 A1 Jul. 5, 2007

Related U.S. Application Data

(63) Continuation-in-part of application No. 10/926,513, filed on Aug. 26, 2004, and a continuation-in-part of application No. 11/286,888, filed on Nov. 23, 2005.

(51) Int. Cl.
*F04B 49/00* (2006.01)

(52) U.S. Cl. ..... 417/44.11; 417/22; 417/43; 417/44.1; 417/53

(58) Field of Classification Search ..... 417/42, 417/43, 44.1, 53, 22, 44.11
See application file for complete search history.

(56) References Cited

U.S. PATENT DOCUMENTS 3,613,805 A 10/1971 Linstad
3,778,804 A * 12/1973 Adair ..... 340/544
3,787,882 A 1/1974 Fillmore
4,133,058 A * 1/1979 Baker ..... 4/494
4,353,220 A 10/1982 Curwen
4,494,180 A 1/1985 Streater
4,610,605 A 9/1986 Hartley
4,635,441 A * 1/1987 Ebbing et al. ..... 60/450
4,678,409 A 7/1987 Kurokawa (Continued)

FOREIGN PATENT DOCUMENTS

DE 19645129 5/1998

(Continued)

OTHER PUBLICATIONS

"Better, Stronger, Faster;" Pool & Spa News, Sep. 3, 2004; pp. 52-54, 82-84, USA.

*Primary Examiner*—Devon C Kramer
*Assistant Examiner*—Leonard J Weinstein
(74) *Attorney, Agent, or Firm*—Greenberg Traurig, LLP

(57) ABSTRACT

A pumping system for moving water of a swimming pool includes a water pump and a variable speed motor. The pumping system further includes means for determining a first motor speed of the motor, means for determining first and second performance values of the pumping system, and means for comparing the first and second performance values. The pumping system further includes means for determining an adjustment value based upon the comparison, means for determining a second motor speed based upon the adjustment value, and means for controlling the motor in response to the second motor speed. In one example, the pumping system includes means for determining a value indicative of a flow rate of water moved by the pump. In addition or alternatively, the pumping system includes a filter arrangement. A method of controlling the pumping system for moving the water of the swimming pool is also disclosed.

11 Claims, 6 Drawing Sheets

U.S. PATENT DOCUMENTS 4,703,387 A 10/1987 Miller
4,767,280 A 8/1988 Markuson
4,795,314 A 1/1989 Prybella
4,834,624 A 5/1989 Jensen
4,912,936 A 4/1990 Denpou
4,963,778 A 10/1990 Jensen
5,026,256 A 6/1991 Kuwabara
5,099,181 A 3/1992 Canon
5,123,080 A 6/1992 Gillett
5,156,535 A 10/1992 Budris
5,158,436 A 10/1992 Jensen
5,167,041 A 12/1992 Burkitt
5,240,380 A 8/1993 Mabe
5,342,176 A 8/1994 Redlich
5,471,125 A 11/1995 Wu
5,512,883 A 4/1996 Lane
5,518,371 A 5/1996 Wellstein
5,519,848 A 5/1996 Wloka
5,520,517 A 5/1996 Sipin
5,571,000 A 11/1996 Zimmermann
5,580,221 A 12/1996 Triezenberg
5,598,080 A 1/1997 Jensen
5,614,812 A 3/1997 Wagoner
5,626,464 A 5/1997 Schoenmeyr
5,628,896 A 5/1997 Klingenberger
5,711,483 A 1/1998 Hays
5,727,933 A 3/1998 Laskaris et al.
5,791,882 A 8/1998 Stucker
5,804,080 A 9/1998 Klingenberger
5,819,848 A 10/1998 Rasmusson
5,883,489 A 3/1999 Konrad
5,909,372 A 6/1999 Thybo
5,941,690 A 8/1999 Lin
5,969,958 A 10/1999 Nielsen
5,973,465 A 10/1999 Rayner
6,037,742 A 3/2000 Rasmussen
6,045,333 A * 4/2000 Breit ..... 417/44.1
6,046,492 A 4/2000 Machida
6,048,183 A 4/2000 Meza
6,072,291 A 6/2000 Pedersen
6,091,604 A 7/2000 Plougsgaard
6,102,665 A 8/2000 Centers
6,125,481 A 10/2000 Sicilano
6,142,741 A 11/2000 Nishihata
6,208,112 B1 3/2001 Jensen
6,254,353 B1 7/2001 Polo
6,264,431 B1 7/2001 Triezenberg
6,299,414 B1 10/2001 Schoenmyr
6,326,752 B1 12/2001 Jensen
6,351,359 B1 2/2002 Jaeger
6,354,805 B1 3/2002 Moller
6,373,728 B1 4/2002 Aarestrup
6,380,707 B1 4/2002 Rosholm
6,406,265 B1 6/2002 Hahn
6,416,295 B1 7/2002 Nagai
6,426,633 B1 7/2002 Thybo
6,450,771 B1 9/2002 Centers
6,464,464 B2 10/2002 Sabini
6,468,042 B2 10/2002 Moller
6,468,052 B2 10/2002 McKain et al.
6,474,949 B1 11/2002 Arai
6,481,973 B1 11/2002 Struthers
6,483,378 B2 11/2002 Blodgett
6,537,032 B1 * 3/2003 Horiuchi et al. ..... 417/18
6,548,976 B2 4/2003 Jensen
6,623,245 B2 9/2003 Meza
6,676,831 B2 * 1/2004 Wolfe ..... 210/85
6,690,250 B2 2/2004 Moller
6,715,996 B2 4/2004 Moeller
6,717,318 B1 4/2004 Mathiassen
6,747,367 B2 * 6/2004 Cline et al. ..... 307/11
6,774,664 B2 8/2004 Godbersen
6,925,823 B2 8/2005 Lifson et al.
7,005,818 B2 2/2006 Jensen
7,050,278 B2 5/2006 Poulsen
7,083,392 B2 8/2006 Meza et al.
7,221,121 B2 5/2007 Skaug et al.
7,244,106 B2 * 7/2007 Kallman et al. ..... 417/44.1
2001/0041139 A1 11/2001 Sabini et al.
2002/0050490 A1 * 5/2002 Pittman et al. ..... 219/481
2002/0070875 A1 * 6/2002 Crumb ..... 340/825.69
2002/0136642 A1 9/2002 Moller
2003/0017055 A1 * 1/2003 Fong ..... 417/44.9
2003/0099548 A1 5/2003 Meza
2003/0196942 A1 * 10/2003 Jones ..... 210/169
2004/0009075 A1 1/2004 Meza
2004/0013531 A1 1/2004 Curry et al.
2004/0055363 A1 * 3/2004 Bristol ..... 73/31.03
2005/0123408 A1 * 6/2005 Koehl ..... 417/53
2005/0190094 A1 9/2005 Andersen
2005/0226731 A1 * 10/2005 Mehlhorn et al. ..... 417/44.11
2006/0045750 A1 3/2006 Stiles
2006/0090255 A1 * 5/2006 Cohen ..... 4/509
2006/0127227 A1 * 6/2006 Mehlhorn et al. ..... 417/53
2007/0114162 A1 5/2007 Stiles
2007/0154319 A1 7/2007 Stiles
2007/0154321 A1 7/2007 Stiles
2007/0154322 A1 7/2007 Stiles
2007/0154323 A1 7/2007 Stiles
2007/0163929 A1 7/2007 Stiles
2007/0183902 A1 8/2007 Stiles

FOREIGN PATENT DOCUMENTS

DE 10231773 2/2004
DE 19938490 4/2005
EP 0314249 5/1989
EP 0709575 5/1996
EP 0735273 10/1996
EP 0978657 2/2000
FR 2529965 6/1983
FR 2703409 10/1994
JP 5010270 1/1993
WO WO 98/04835 2/1998
WO WO 01/47099 6/2001
WO WO 2004/006416 1/2004
WO WO 2004/088694 10/2004
WO WO 2006/069568 7/2006

* cited by examiner

FLOW CONTROL

RELATED APPLICATIONS

This application is a continuation-in-part application of U.S. application Ser. No. 10/926,513, filed Aug. 26, 2004, and U.S. application Ser. No. 11/286,888, filed Nov. 23, 2005, the entire disclosures of which are hereby incorporated herein by reference.

FIELD OF THE INVENTION

The present invention relates generally to control of a pump, and more particularly to control of a variable speed pumping system for a pool.

BACKGROUND OF THE INVENTION

Conventionally, a pump to be used in a pool is operable at a finite number of predetermined speed settings (e.g., typically high and low settings). Typically these speed settings correspond to the range of pumping demands of the pool at the time of installation. Factors such as the volumetric flow rate of water to be pumped, the total head pressure required to adequately pump the volume of water, and other operational parameters determine the size of the pump and the proper speed settings for pump operation. Once the pump is installed, the speed settings typically are not readily changed to accommodate changes in the pool conditions and/or pumping demands.

During use, it is possible that a conventional pump is manually adjusted to operate at one of the finite speed settings. Resistance to the flow of water at an intake of the pump causes a decrease in the volumetric pumping rate if the pump speed is not increased to overcome this resistance. Further, adjusting the pump to one of the settings may cause the pump to operate at a rate that exceeds a needed rate, while adjusting the pump to another setting may cause the pump to operate at a rate that provides an insufficient amount of flow and/or pressure. In such a case, the pump will either operate inefficiently or operate at a level below that which is desired.

Accordingly, it would be beneficial to provide a pump that could be readily and easily adapted to provide a suitably supply of water at a desired pressure to pools having a variety of sizes and features. The pump should be customizable on-site to meet the needs of the particular pool and associated features, capable of pumping water to a plurality of pools and features, and should be variably adjustable over a range of operating speeds to pump the water as needed when conditions change. Further, the pump should be responsive to a change of conditions and/or user input instructions.

SUMMARY OF THE INVENTION

In accordance with one aspect, the present invention provides a pumping system for moving water of a swimming pool. The pumping system includes a water pump for moving water in connection with performance of an operation upon the water and a variable speed motor operatively connected to drive the pump. The pumping system further includes means for determining a first motor speed of the motor and means for determining a value indicative of a flow rate of water moved by the pump. The pumping system further includes means for determining a first performance value of the pumping system, wherein the first performance value is based upon the determined flow rate, means for determining a second performance value of the pumping system, means for comparing the first performance value to the second performance value, and means for determining an adjustment value based upon the comparison of the first and second performance values. The pumping system further includes means for determining a second motor speed based upon the adjustment value, and means for controlling the motor in response to the second motor speed.

In accordance with another aspect, the present invention provides a pumping system for moving water of a swimming pool. The pumping system includes a water pump for moving water in connection with performance of a filtering operation upon the water through a fluid circuit that includes at least the water pump and the swimming pool, a variable speed motor operatively connected to drive the pump, and a filter arrangement in fluid communication with the fluid circuit and configured to filter the water moved by the water pump. The pumping system further includes means for determining a first motor speed of the motor, means for determining a first performance value of the pumping system, means for determining a second performance value of the pumping system, and means for comparing the first performance value to the second performance value. The pumping system further includes means for determining an adjustment value based upon the comparison of the first and second performance values, means for determining a second motor speed based upon the adjustment value, and means for controlling the motor in response to the second motor speed.

In accordance with another aspect, the present invention provides a method of controlling a pumping system for moving water of a swimming pool including a water pump for moving water in connection with performance of a filtering operation upon the water, a filter arrangement in fluid communication with the pump, a variable speed motor operatively connected to drive the pump, and a controller operatively connected to the motor. The method comprises the steps of determining a first motor speed of the motor, determining a first performance value based upon the first motor speed, determining a second first performance value, and comparing the first performance value to the second performance value. The method also comprises the steps of determining an adjustment value based upon the comparison of the first and second performance values, determining a second motor speed based upon the adjustment value, and controlling the motor in response to the second motor speed.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
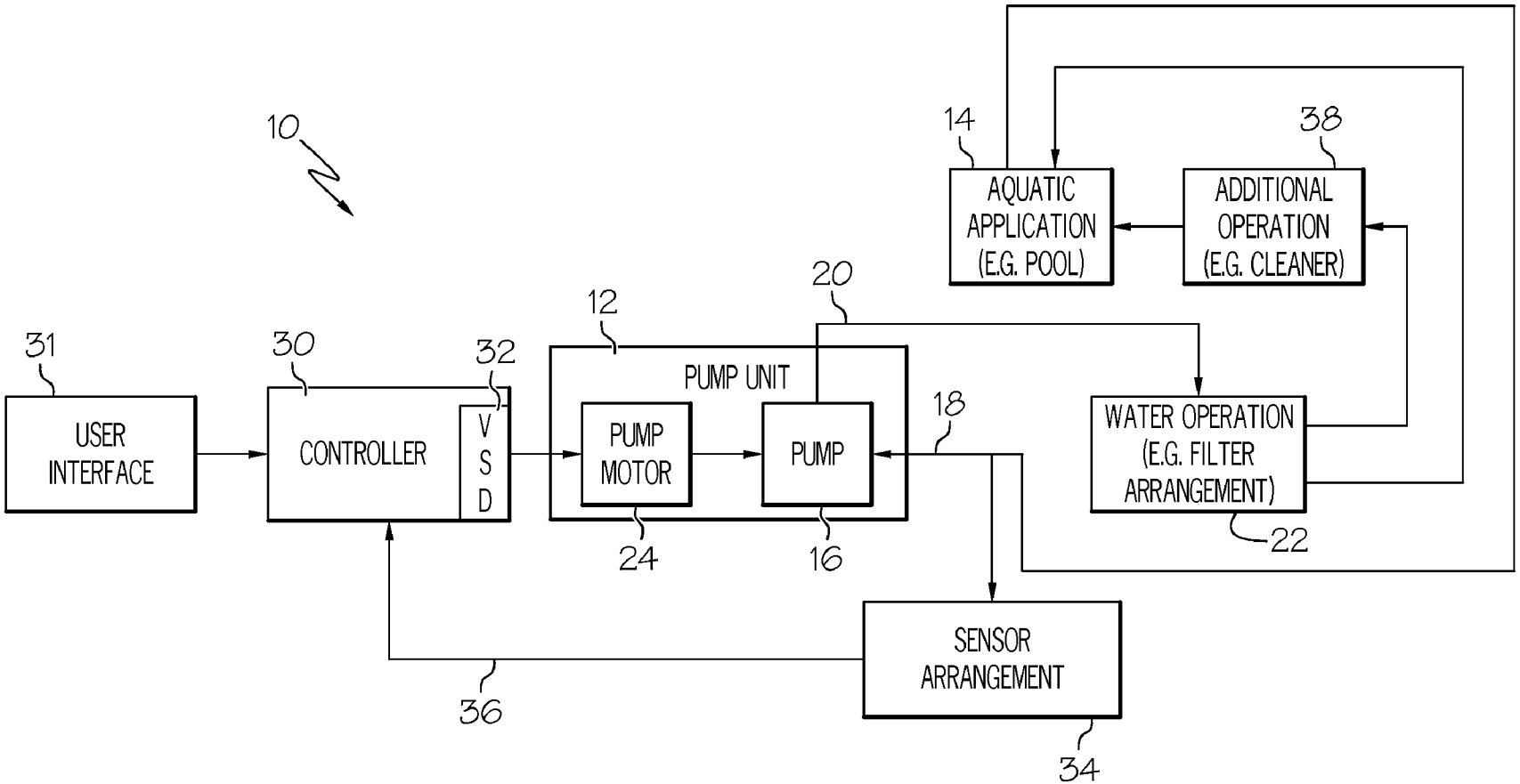
FIG. 1 is a block diagram of an example of a variable speed pumping system in accordance with the present invention with a pool environment.

Certain terminology is used herein for convenience only and is not to be taken as a limitation on the present invention. Further, in the drawings, the same reference numerals are employed for designating the same elements throughout the figures, and in order to clearly and concisely illustrate the present invention, certain features may be shown in somewhat schematic form.

An example variable-speed pumping system 10 in accordance with one aspect of the present invention is schematically shown in FIG. 1. The pumping system 10 includes a pump unit 12 that is shown as being used with a swimming pool 14. It is to be appreciated that the pump unit 12 includes a pump 16 for moving water through inlet and outlet lines 18 and 20.

The swimming pool 14 is one example of a pool. The definition of "swimming pool" includes, but is not limited to, swimming pools, spas, and whirlpool baths, and further includes features and accessories associated therewith, such as water jets, waterfalls, fountains, pool filtration equipment, chemical treatment equipment, pool vacuums, spillways and the like.

A water operation 22 is performed upon the water moved by the pump 16. Within the shown example, water operation 22 is a filter arrangement that is associated with the pumping system 10 and the swimming pool 14 for providing a cleaning operation (i.e., filtering) on the water within the pool. The filter arrangement 22 can be operatively connected between the swimming pool 14 and the pump 16 at/along an inlet line 18 for the pump. Thus, the pump 16, the swimming pool 14, the filter arrangement 22, and the interconnecting lines 18 and 20 can form a fluid circuit or pathway for the movement of water.

It is to be appreciated that the function of filtering is but one example of an operation that can be performed upon the water. Other operations that can be performed upon the water may be simplistic, complex or diverse. For example, the operation performed on the water may merely be just movement of the water by the pumping system (e.g., re-circulation of the water in a waterfall or spa environment).

Turning to the filter arrangement 22, any suitable construction and configuration of the filter arrangement is possible. For example, the filter arrangement 22 may include a skimmer assembly for collecting coarse debris from water being withdrawn from the pool, and one or more filter components for straining finer material from the water.

The pump 16 may have any suitable construction and/or configuration for providing the desired force to the water and move the water. In one example, the pump 16 is a common centrifugal pump of the type known to have impellers extending radially from a central axis. Vanes defined by the impellers create interior passages through which the water passes as the impellers are rotated. Rotating the impellers about the central axis imparts a centrifugal force on water therein, and thus imparts the force flow to the water. Although centrifugal pumps are well suited to pump a large volume of water at a continuous rate, other motor-operated pumps may also be used within the scope of the present invention.

Drive force is provided to the pump 16 via a pump motor 24. In the one example, the drive force is in the form of rotational force provided to rotate the impeller of the pump 16. In one specific embodiment, the pump motor 24 is a permanent magnet motor. In another specific embodiment, the pump motor 24 is an induction motor. In yet another embodiment, the pump motor 24 can be a synchronous or asynchronous motor. The pump motor 24 operation is infinitely variable within a range of operation (i.e., zero to maximum operation). In one specific example, the operation is indicated by the RPM of the rotational force provided to rotate the impeller of the pump 16. In the case of a synchronous motor 24, the steady state speed (RPM) of the motor 24 can be referred to as the synchronous speed. Further, in the case of a synchronous motor 24, the steady state speed of the motor 24 can also be determined based upon the operating frequency in hertz (Hz). Thus, either or both of the pump 16 and/or the motor 24 can be configured to consume power during operation.

A controller 30 provides for the control of the pump motor 24 and thus the control of the pump 16. Within the shown example, the controller 30 includes a variable speed drive 32 that provides for the infinitely variable control of the pump motor 24 (i.e., varies the speed of the pump motor). By way of example, within the operation of the variable speed drive 32, a single phase AC current from a source power supply is converted (e.g., broken) into a three-phase AC current. Any suitable technique and associated construction/configuration may be used to provide the three-phase AC current. The variable speed drive supplies the AC electric power at a changeable frequency to the pump motor to drive the pump motor. The construction and/or configuration of the pump 16, the pump motor 24, the controller 30 as a whole, and the variable speed drive 32 as a portion of the controller 30, are not limitations on the present invention. In one possibility, the pump 16 and the pump motor 24 are disposed within a single housing to form a single unit, and the controller 30 with the variable speed drive 32 are disposed within another single housing to form another single unit. In another possibility, these components are disposed within a single housing to form a single unit. Further still, the controller 30 can receive input from a user interface 31 that can be operatively connected to the controller in various manners.

The pumping system 10 has means used for control of the operation of the pump. In accordance with one aspect of the present invention, the pumping system 10 includes means for sensing, determining, or the like one or more parameters or performance values indicative of the operation performed upon the water. Within one specific example, the system includes means for sensing, determining or the like one or more parameters or performance values indicative of the movement of water within the fluid circuit.

The ability to sense, determine or the like one or more parameters or performance values may take a variety of forms. For example, one or more sensors 34 may be utilized. Such one or more sensors 34 can be referred to as a sensor arrangement. The sensor arrangement 34 of the pumping system 10 would sense one or more parameters indicative of the operation performed upon the water. Within one specific example, the sensor arrangement 34 senses parameters indicative of the movement of water within the fluid circuit. The movement along the fluid circuit includes movement of water through the filter arrangement 22. As such, the sensor arrangement 34 can include at least one sensor used to determine flow rate of the water moving within the fluid circuit and/or includes at least one sensor used to determine flow pressure of the water moving within the fluid circuit. In one example, the sensor arrangement 34 can be operatively connected with the water circuit at/adjacent to the location of the filter arrangement 22. It should be appreciated that the sensors of the sensor arrangement 34 may be at different locations than the locations presented for the example. Also, the sensors of the sensor arrangement 34 may be at different locations from each other. Still further, the sensors may be configured such that different sensor portions are at different locations within the fluid circuit. Such a sensor arrangement 34 would be operatively connected 36 to the controller 30 to provide the sensory information thereto. Further still, one or more sensor arrangement(s) 34 can be used to sense parameters or performance values of other components, such as the motor (e.g., motor speed or power consumption) or even values within program data running within the controller 30.

It is to be noted that the sensor arrangement 34 may accomplish the sensing task via various methodologies, and/or different and/or additional sensors may be provided within the system 10 and information provided therefrom may be utilized within the system. For example, the sensor arrangement 34 may be provided that is associated with the filter arrangement and that senses an operation characteristic associated with the filter arrangement. For example, such a sensor may monitor filter performance. Such monitoring may be as basic as monitoring filter flow rate, filter pressure, or some other parameter that indicates performance of the filter arrangement. Of course, it is to be appreciated that the sensed parameter of operation may be otherwise associated with the operation performed upon the water. As such, the sensed parameter of operation can be as simplistic as a flow indicative parameter such as rate, pressure, etc.

Such indication information can be used by the controller 30, via performance of a program, algorithm or the like, to perform various functions, and examples of such are set forth below. Also, it is to be appreciated that additional functions and features may be separate or combined, and that sensor information may be obtained by one or more sensors.

With regard to the specific example of monitoring flow rate and flow pressure, the information from the sensor arrangement 34 can be used as an indication of impediment or hindrance via obstruction or condition, whether physical, chemical, or mechanical in nature, that interferes with the flow of water from the pool to the pump such as debris accumulation or the lack of accumulation, within the filter arrangement 34. As such, the monitored information is indicative of the condition of the filter arrangement.

Figure 2:
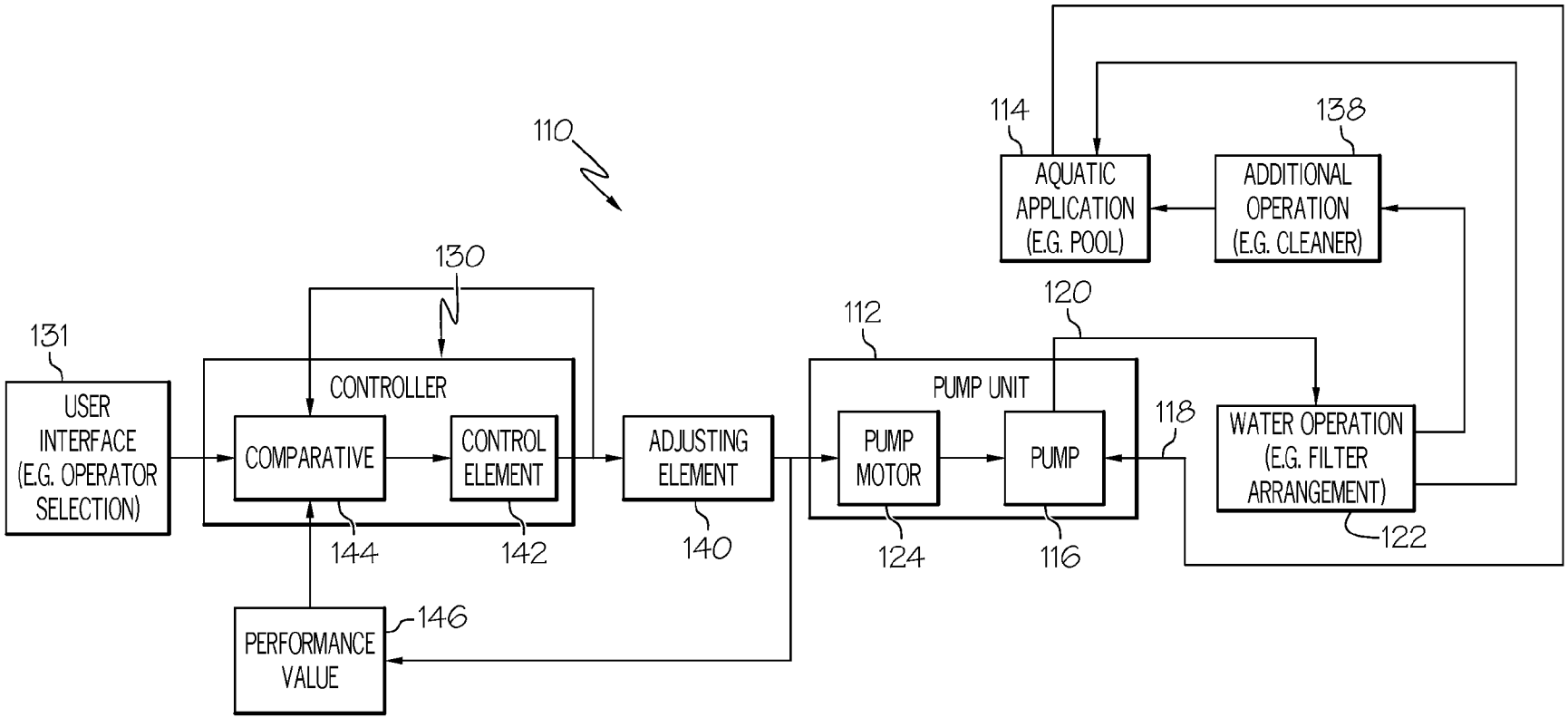
FIG. 2 is another block diagram of another example of a variable speed pumping system in accordance with the present invention with a pool environment.

The example of FIG. 1 shows an example additional operation 38 and the example of FIG. 2 shows an example additional operation 138. Such an additional operation (e.g., 38 or 138) may be a cleaner device, either manual or autonomous. As can be appreciated, an additional operation involves additional water movement. Also, within the presented examples of FIGS. 1 and 2, the water movement is through the filter arrangement (e.g., 22 or 122). Such additional water movement may be used to supplant the need for other water movement.

Within another example (FIG. 2) of a pumping system 110 that includes means for sensing, determining, or the like one or more parameters indicative of the operation performed upon the water, the controller 130 can determine the one or more parameters via sensing, determining or the like parameters associated with the operation of a pump 116 of a pump unit 112. Such an approach is based upon an understanding that the pump operation itself has one or more relationships to the operation performed upon the water.

It should be appreciated that the pump unit 112, which includes the pump 116 and a pump motor 124, a pool 114, a filter arrangement 122, and interconnecting lines 118 and 120, may be identical or different from the corresponding items within the example of FIG. 1. In addition, as stated above, the controller 130 can receive input from a user interface 131 that can be operatively connected to the controller in various manners.

Turning back to the example of FIG. 2, some examples of the pumping system 110, and specifically the controller 130 and associated portions, that utilize at least one relationship between the pump operation and the operation performed upon the water attention are shown in U.S. Pat. No. 6,354,805, to Moller, entitled "Method For Regulating A Delivery Variable Of A Pump" and U.S. Pat. No. 6,468,042, to Moller, entitled "Method For Regulating A Delivery Variable Of A Pump." The disclosures of these patents are incorporated herein by reference.

Although the system 110 and the controller 130 may be of varied construction, configuration and operation, the function block diagram of FIG. 2 is generally representative. Within the shown example, an adjusting element 140 is operatively connected to the pump motor and is also operatively connected to a control element 142 within the controller 130. The control element 142 operates in response to a comparative function 144, which receives input from one or more performance value(s) 146.

The performance value(s) 146 can be determined utilizing information from the operation of the pump motor 124 and controlled by the adjusting element 140. As such, a feedback iteration can be performed to control the pump motor 124. Also, operation of the pump motor and the pump can provide the information used to control the pump motor/pump. As mentioned, it is an understanding that operation of the pump motor/pump has a relationship to the flow rate and/or pressure of the water flow that is utilized to control flow rate and/or flow pressure via control of the pump.

As mentioned, the sensed, determined (e.g., calculated, provided via a look-up table, graph or curve, such as a constant flow curve or the like, etc.) information can be utilized to determine the various performance characteristics of the pumping system 110, such as input power consumed, motor speed, flow rate and/or the flow pressure. In one example, the operation can be configured to prevent damage to a user or to the pumping system 10, 110 caused by an obstruction. Thus, the controller (e.g., 30 or 130) provides the control to operate the pump motor/pump accordingly. In other words, the controller (e.g., 30 or 130) can repeatedly monitor one or more performance value(s) 146 of the pumping system 10,110, such as the input power consumed by, or the speed of, the pump motor (e.g., 24 or 124) to sense or determine a parameter indicative of an obstruction or the like.

Turning to the issue of operation of the system (e.g., 10 or 110) over a course of a long period of time, it is typical that a predetermined volume of water flow is desired. For example, it may be desirable to move a volume of water equal to the volume within the swimming pool (e.g., pool or spa). Such movement of water is typically referred to as a turnover. It may be desirable to move a volume of water equal to multiple turnovers within a specified time period (e.g., a day). Within an example in which the water operation includes a filter operation, the desired water movement (e.g., specific number of turnovers within one day) may be related to the necessity to maintain a desired water clarity.

In another example, the system (e.g., 10 or 110) may operate to have different constant flow rates during different time periods. Such different time periods may be sub-periods (e.g., specific hours) within an overall time period (e.g., a day) within which a specific number of water turnovers is desired.

During some time periods a larger flow rate may be desired, and a lower flow rate may be desired at other time periods. Within the example of a swimming pool with a filter arrangement as part of the water operation, it may be desired to have a larger flow rate during pool-use time (e.g., daylight hours) to provide for increased water turnover and thus increased filtering of the water. Within the same swimming pool example, it may be desired to have a lower flow rate during non-use (e.g., nighttime hours).

Within the water operation that contains a filter operation, the amount of water that can be moved and/or the ease by which the water can be moved is dependent in part upon the current state (e.g., quality) of the filter arrangement. In general, a clean (e.g., new, fresh) filter arrangement provides a lesser impediment to water flow than a filter arrangement that has accumulated filter matter (e.g., dirty). For a constant flow rate through a filter arrangement, a lesser pressure is required to move the water through a clean filter arrangement than a pressure that is required to move the water through a dirty filter arrangement. Another way of considering the effect of dirt accumulation is that if pressure is kept constant then the flow rate will decrease as the dirt accumulates and hinders (e.g., progressively blocks) the flow.

Turning to one aspect that is provided by the present invention, the system can operate to maintain a constant flow of water within the fluid circuit. Maintenance of constant flow is useful in the example that includes a filter arrangement. Moreover, the ability to maintain a constant flow is useful when it is desirable to achieve a specific flow volume during a specific period of time. For example, it may be desirable to filter pool water and achieve a specific number of water turnovers within each day of operation to maintain a desired water clarity despite the fact that the filter arrangement will progressively increase dirt accumulation.

It should be appreciated that maintenance of a constant flow volume despite an increasing impediment caused by filter dirt accumulation can require an increasing pressure and is the result of increasing motive force from the pump/motor. As such, one aspect of the present invention is to control the motor/pump to provide the increased motive force that provides the increased pressure to maintain the constant flow.

Figure 3:
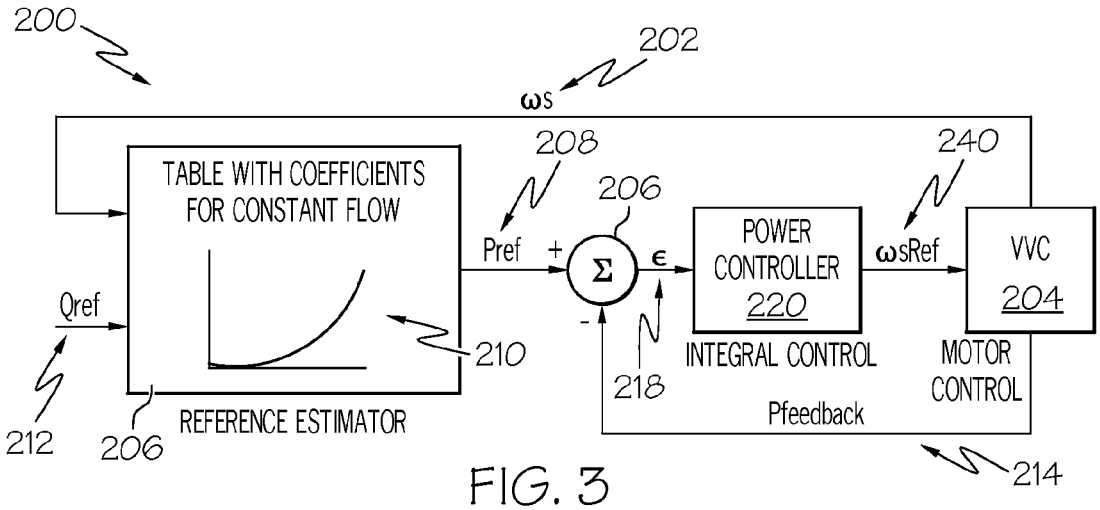
FIG. 3 is a block diagram an example flow control process in accordance with an aspect of the present invention.

Turning to one specific example, attention is directed to the block diagram of an example control system that is shown in FIG. 3. It is to be appreciated that the block diagram as shown is intended to be only one example method of operation, and that more or less elements can be included in various orders. For the sake of clarity, the example block diagram described below can control the flow of the pumping system based on a detection of a performance value, such as a change in the power consumption (i.e., watts) of the pump unit 12,112 and/or the pump motor 24, 124, though it is to be appreciated that various other performance values (i.e., motor speed, flow rate and/or flow pressure of water moved by the pump unit 12, 112, filter loading, or the like) can also be used though either direct or indirect measurement and/or determination. Thus, in one example, the flow rate of water through the fluid circuit can be controlled upon a determination of a change in power consumption and/or associated other performance values (e.g., relative amount of change, comparison of changed values, time elapsed, number of consecutive changes, etc.). The change in power consumption can be determined in various ways. In one example, the change in power consumption can be based upon a measurement of electrical current and electrical voltage provided to the motor 24, 124. Various other factors can also be included, such as the power factor, resistance, and/or friction of the motor 24, 124 components, and/or even physical properties of the swimming pool, such as the temperature of the water. Further, as stated previously, the flow rate of the water can be controlled by a comparison of other performance values. Thus, in another example, the flow rate of the water through the pumping system 10, 110 can be controlled through a determination of a change in a measured flow rate. In still yet another example, the flow rate of water through the fluid circuit can be controlled based solely upon a determination of a change in power consumption of the motor 24, 124 without any other sensors. In such a "sensorless" system, various other variables (e.g., flow rate, flow pressure, motor speed, etc.) can be either supplied by a user, other system elements, and/or determined from the power consumption.

Turning to the block diagram shown in FIG. 3, an example flow control process 200 is shown schematically. It is to be appreciated that the flow control process 200 can be an iterative and/or repeating process, such as a computer program or the like. As such, the process 200 can be contained within a constantly repeating loop, such as a "while" loop, "if-then" loop, or the like, as is well known in the art. In one example, the "while" or "if-then" loop can cycle at predetermined intervals, such as once every 100 milliseconds. Further, it is to be appreciated that the loop can include various methods of breaking out of the loop due to various conditions and/or user inputs. In one example, the loop can be broken (and the program restarted) if a user changes an input value or a blockage or other alarm condition is detected in the fluid circuit.

Thus, the process 200 can be initiated with a determination of a first motor speed 202 ($\omega s$) of the motor 24, 124. In the example embodiment where the motor 24, 124 is a synchronous motor, the first motor speed ($\omega s$) can be referred to as the first synchronous motor speed. It is to be appreciated that, for a given time/iterative cycle, the first motor speed 202 is considered to be the present shaft speed of the motor 24, 124. The first motor speed 202 ($\omega s$) can be determined in various manners. In one example, the first motor speed 202 can be provided by the motor controller 204. The motor controller 204 can determine the first motor speed 202, for example, by way of a sensor configured to measure, directly or indirectly, revolutions per minute (RPM) of the motor 24, 124 shaft speed. It is to be appreciated that the motor controller 204 can provide a direct value of shaft speed ($\omega s$) in RPM, or it can provide it by way of an intermediary, such as, for example, an electrical value (electrical voltage and/or electrical current), power consumption, or even a discrete value (i.e., a value between the range of 1 to 128 or the like). It is also to be appreciated that the first motor speed 202 can be determined in various other manners, such as by way of a sensor (not shown) separate and apart from the motor controller 204.

Next, the process 200 can determine a first performance value of the pumping system 10, 110. In one example, as shown, the process 200 can use a reference estimator 206 to determine a reference power consumption 208 (Pref) of the motor 24, 124. The reference estimator 206 can determine the reference power consumption 208 (Pref) in various manners, such as by calculation or by values stored in memory or found in a look-up table, graph, curve or the like. In one example, the reference estimator 206 can contain a one or more predetermined pump curves 210 or associated tables using various variables (e.g., flow, pressure, speed, power, etc.). The curves or tables can be arranged or converted in various manners, such as into constant flow curves or associated tables. For example, the curves 210 can be arranged as a plurality of power (watts) versus speed (RPM) curves for discrete flow rates (e.g., flow curves for the range of 15 GPM to 130 GPM in 1 GPM increments) and stored in the computer program memory. Thus, for a given flow rate, one can use a known value, such as the first motor speed 202 (ωs) to determine (e.g., calculate or look-up) the first performance value (i.e., the reference power consumption 208 (Pref) of the motor 24, 124). The pump curves 210 can have the data arranged to fit various mathematical models, such as linear or polynomial equations, that can be used to determine the performance value.

Thus, where the pump curves 210 are based upon constant flow values, a reference flow rate 212 (Qref) for the pumping system 10, 110 should also be determined. The reference flow rate 212 (Qref) can be determined in various manners. In one example, the reference flow rate 212 can be retrieved from a program menu, such as through user interface 31, 131, or even from other sources, such as another controller and/or program. In addition or alternatively, the reference flow rate 212 can be calculated or otherwise determined (e.g., stored in memory or found in a look-up table, graph, curve or the like) by the controller 30, 130 based upon various other input values. For example, the reference flow rate 212 can be calculated based upon the size of the swimming pool (i.e., volume), the number of turnovers per day required, and the time range that the pumping system 10, 110 is permitted to operate (e.g., a 15,000 gallon pool size at 1 turnover per day and 5 hours run time equates to 50 GPM). The reference flow rate 212 may take a variety of forms and may have a variety of contents, such as a direct input of flow rate in gallons per minute (GPM).

Next, the flow control process 200 can determine a second performance value of the pumping system 10, 110. In accordance with the current example, the process 200 can determine the present power consumption 214 (Pfeedback) of the motor 24, 124. Thus, for the present time/iterative cycle, the value (Pfeedback) is considered to be the present power consumption of the motor 24, 124. In one example, the present power consumption 214 can be based upon a measurement of electrical current and electrical voltage provided to the motor 24, 124, though various other factors can also be included, such as the power factor, resistance, and/or friction of the motor 24, 124 components. The present power consumption can be measured directly or indirectly, as can be appreciated. For example, the motor controller 204 can determine the present power consumption (Pfeedback), such as by way of a sensor configured to measure, directly or indirectly, the electrical voltage and electrical current consumed by the motor 24, 124. It is to be appreciated that the motor controller 204 can provide a direct value of present power consumption (i.e., watts), or it can provide it by way of an intermediary or the like. It is also to be appreciated that the present power consumption 214 can also be determined in various other manners, such as by way of a sensor (not shown) separate and apart from the motor controller 204.

Next, the flow control process 200 can compare the first performance value to the second performance value. For example, the process 200 can perform a difference calculation 216 to find a difference value (ϵ) 218 between the first and second performance values. Thus, as shown, the difference calculation 216 can subtract the present power consumption 214 from the reference power consumption 208 (i.e., Pref–Pfeedback) to determine the difference value (ϵ) 218. Because (Pref) 208 and (Pfeedback) 214 can be measured in watts, the difference value (ϵ) 218 can also be in terms of watts, though it can also be in terms of other values and/or signals. It is to be appreciated that various other comparisons can also be performed based upon the first and second performance values, and such other comparisons can also include various other values and steps, etc. For example, the reference power consumption 208 can be compared to a previous power consumption (not shown) of a previous program or time cycle that can be stored in memory (i.e., the power consumption determination made during a preceding program or time cycle, such as the cycle of 100 milliseconds prior).

Next, the flow control process 200 can determine an adjustment value based upon the comparison of the first and second comparison values. The adjustment value can be determined by a controller, such as a power 220, in various manners. In one example, the power controller 220 can comprise a computer program, though it can also comprise a hardware-based controller (e.g., analog, analog/digital, or digital). In a more specific embodiment, the power controller 220 can include at least one of the group consisting of a proportional (P) controller, an integral (I) controller, a proportional integral (PI) controller, a proportional derivative controller (PD), and a proportional integral derivative (PID) controller, though various other controller configurations are also contemplated to be within the scope of the invention. For the sake of clarity, the power controller 220 will be described herein in accordance with an integral (I) controller.

Figure 4:
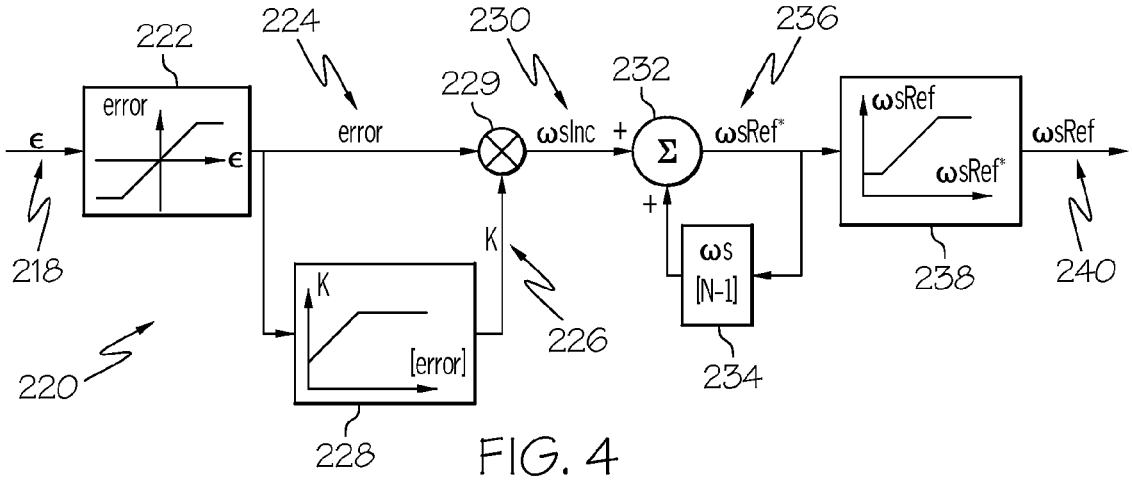
FIG. 4 is a block diagram of an example controller in accordance with an aspect of the present invention.

Turning now to the example block diagram of FIG. 4, an integral control-based version of the power controller 220 is shown in greater detail. It is to be appreciated that the shown power controller 220 is merely one example of various control methodologies that can be employed, and as such more or less steps, variables, inputs and/or outputs can also be used. As shown, an input to the power controller 220 can be the difference value (ϵ) 218 from the comparison between the first and second performance values. In one example, the difference value (ϵ) 218 can first be limited 222 to a predetermined range to help stabilize the control scheme (i.e., to become an error value 224). In one example, the difference value (ϵ) 218 can be limited to a maximum value of 200 watts to inhibit large swings in control of the motor speed, though various other values are also contemplated to be within the scope of the invention. In addition or alternatively, various other modifications, corrections, or the like can be performed on the difference value (ϵ) 218.

Next, in accordance with the integral control scheme, the power controller 220 can determine an integration constant (K) 226. The integration constant (K) 226 can be determined in various manners, such as calculated, retrieved from memory, or provided via a look-up table, graph or curve, etc. In one example, the integration constant (K) 226 can be calculated 228 (or retrieved from a look-up table) based upon the error value 224 to thereby modify the response speed of the power controller 220 depending upon the magnitude of the error value 224. As such, the integration constant (K) can be increased when the error value 224 is relatively larger to thereby increase the response of the power controller 220 (i.e., to provide relatively larger speed changes), and correspondingly the integration constant (K) can be decreased when the error value 224 is relatively lesser to thereby decrease the response of the power controller 220 (i.e., to achieve a stable control with relatively small speed changes). It is to be appreciated that the determined integration constant (K) can also be limited to a predetermined range to help to stabilize the power controller 220.

Further still, the determined integration constant (K) 226 can also be used for other purposes, such as to determine a wait time before the next iterative cycle of the process 200. In a pumping system 10, 110 as described herein, power consumption by the pump unit 12, 112 and/or pump motor 24, 124 is dependent upon the speed of the motor. Thus, a change in the motor speed can result in a corresponding change in power consumption by the pump motor 24, 124. Further, during a motor speed change, torque ripple or the like from the motor 24, 124 can influence power consumption determinations and may even cause oscillations in the power consumption during the transition and settling/stabilization stages of the speed change. Thus, for example, when the error value 224 and integration constant (K) 226 are relatively greater (i.e., resulting in a relatively greater motor speed change), the iterative process cycle time can be increased to permit a greater transition and/or stabilization time. Likewise, the iterative process cycle time can stay the same or decrease when the error value 224 and integration constant (K) 226 are relatively lesser.

Next, the power controller 220 can determine an adjustment value 230 based upon the error value 224 (which was based upon the aforementioned comparison between the first and second performance values) and the integration constant (K) 226. In one example, the error value 224 (i.e., watts) can be multiplied 229 with the integration constant (K) 226 to determine the adjustment value 230 (ωsInc), though various other relationships and/or operations can be performed (e.g., other calculations, look-up tables, etc.) to determine the adjustment value 230 (ωsInc).

Next, the power controller 220 can determine a second motor speed 236 (ωsRef*) based upon the adjustment value 230 (ωsInc). In one example, the power controller 220 can perform a summation calculation 232 to add the adjustment value 230 (ωsInc) to the motor speed 234 (ωs[n−1]) of the previous time/iteration cycle. It is to be appreciated that because the error value 224 can be either positive or negative, the adjustment value 230 can also be either positive or negative. As such, the second motor speed 236 (ωsRef*) can be greater than, less than, or the same as the motor speed 234 (ωs[n−1]) of the previous time/iteration cycle. Further, the second motor speed 236 (ωsRef*) can be limited 238 to a predetermined range to help retain the motor speed within a predetermined speed range. In one example, the second motor speed 236 (ωsRef*) can be limited to a minimum value of 800 RPM and maximum value of 3450 RPM to inhibit the motor speed from exceeding its operating range, though various other values are also contemplated to be within the scope of the invention. In another example, the second motor speed 236 (ωsRef*) can be limited based upon a predetermined range of relative change in motor speed as compared to the first motor speed 202 (ωs). In addition or alternatively, various other modifications, corrections, or the like can be performed on the second motor speed 236 (ωsRef*).

Returning now to the block diagram of FIG. 3, the power controller 220 can thereby output the determined second motor speed 240 (ωsRef). The motor controller 204 can use the second motor speed 240 (ωsRef) as an input value and can attempt to drive the pump motor 24, 124 at the new motor speed 240 (ωsRef) until a steady state condition (i.e., synchronous speed) is reached. In one example, the motor controller 204 can have an open loop design (i.e., without feedback sensors, such as position sensors located on the rotor or the like), though other designs (i.e., closed loop) are also contemplated. Further still, it is to be appreciated that the motor controller 204 can insure that the pump motor 24, 124 is running at the speed 240 (ωsRef) provided by the power controller 220 because, at a steady state condition, the speed 240 (ωsRef) will be equal to the determined second motor present motor speed 202 (ωs).

Figure 5:
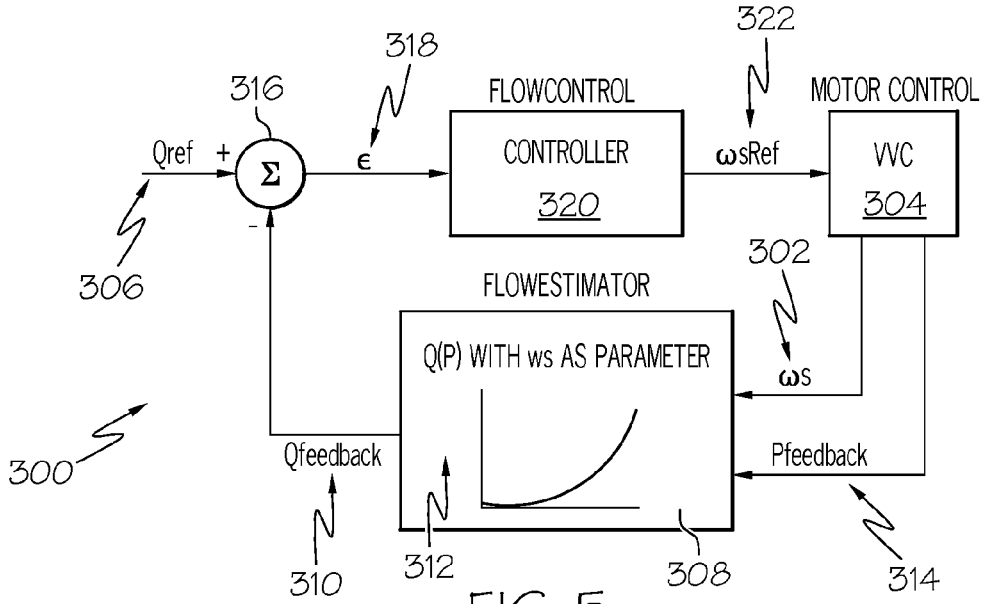
FIG. 5 is a block diagram of another example flow control process in accordance with another aspect of the present invention.

Turning now to the block diagram shown in FIG. 5, another example flow control process 300 is shown in accordance with another aspect of the invention. In contrast to the previous control scheme, the present control process 300 can provide flow control based upon a comparison of water flow rates through the pumping system 10, 100. However, it is to be appreciated that this flow control process 300 shown can include some or all of the features of the aforementioned flow control process 200, and can also include various other features as well. Thus, for the sake of brevity, it is to be appreciated that various details can be shown with reference to the previous control process 200 discussion.

As before, the present control process 300 can be an iterative and/or repeating process, such as a computer program or the like. Thus, the process 300 can be initiated with a determination of a first motor speed 302 (ωs) of the motor 24, 124. As before, the motor 24, 124 can be a synchronous motor, and the first motor speed 302 (ωs) can be referred to as a synchronous motor speed. It is to be appreciated that, for a given time/iterative cycle, the first motor speed 302 is considered to be the present shaft speed of the motor 24, 124. Also, as before, the first motor speed 302 (ωs) can be determined in various manners, such as being provided by the motor controller 304. The motor controller 304 can determine the first motor speed 302, for example, by way of a sensor configured to measure, directly or indirectly, revolutions per minute (RPM) of the motor 24, 124 shaft speed, though it can also be provided by way of an intermediary or the like, or even by way of a sensor (not shown) separate and apart from the motor controller 304.

Next, the process 300 can determine a first performance value. As shown, the first performance value can be a reference flow rate 306 (Qref). The reference flow rate 306 (Qref) can be determined in various manners. In one example, the reference flow rate 306 can be retrieved from a program menu, such as through user interface 31, 131. In addition or alternatively, the reference flow rate 306 can be calculated or otherwise determined (e.g., stored in memory or found in a look-up table, graph, curve or the like) by the controller 30, 130 based upon various other input values (time, turnovers, pool size, etc.). As before, the reference flow rate 306 may take a variety of forms and may have a variety of contents, such as a direct input of flow rate in gallons per minute (GPM).

Next, the process 300 can determine a second performance value of the pumping system 10, 110. As shown, the process 300 can use a feedback estimator 308 (flowestimator) to determine a present water flow rate 310 (Qfeedback) of the pumping system 10, 110. The feedback estimator 308 can determine the present flow rate (Qfeedback) in various manners, such as by calculation or by values stored in memory or found in a look-up table, graph, curve or the like. As before, in one example, the feedback estimator 308 can contain a one or more predetermined pump curves 312 or associated tables using various variables (e.g., flow, pressure, speed, power, etc.). The curves or tables can be arranged or converted in various manners, such as into constant power curves or associated tables. For example, the curves 312 can be arranged as a speed (RPM) versus flow rate (Q) curves for discrete power consumptions of the motor 24, 124 and stored in the computer program memory. Thus, for a given power consumption (Pfeedback), one can use a known value, such as the first motor speed 302 (ωs) to determine (e.g., calculate or look-up) the second performance value (i.e., the present water flow rate 310 (Qfeedback) of the pumping system 10, 110). As before, the pump curves 312 can have the data arranged to fit various mathematical models, such as linear or polynomial equations, that can be used to determine the performance value.

Thus, where the pump curves 312 are based upon constant power values, a present power consumption 314 (Pfeedback) should also be determined. The present power consumption 314 (Pfeedback) can be determined in various manners. In one example, the present power consumption 314 (Pfeedback) can be determined from a measurement of the present electrical voltage and electrical current consumed by the motor 24, 124, though various other factors can also be included, such as the power factor, resistance, and/or friction of the motor 24, 124 components. The present power consumption can be measured directly or indirectly, as can be appreciated, and can even be provided by the motor control 304 or other sources.

Next, the flow control process 300 can compare the first performance value to the second performance value. For example, the process 300 can perform a difference calculation 316 to find a difference value (ϵ) 318 between the first and second performance values. Thus, as shown, the difference calculation 316 can subtract the present flow rate (Qfeedback) from the reference flow rate 306 (Qref) (i.e., Qref−Qfeedback) to determine the difference value (ϵ) 318. Because Qref 306 and Qfeedback 310 can be measured in GPM, the difference value (ϵ) 318 can also be in terms of GPM, though it can also be in terms of other values and/or signals. It is to be appreciated that various other comparisons can also be performed based upon the first and second performance values, and such other comparisons can also include various other values and steps, etc. For example, the reference flow rate 306 can be compared to a previous flow rate (not shown) of a previous program or time cycle stored in memory (i.e., the power consumption determination made during a preceding program or time cycle, such as that of 100 milliseconds prior).

Next, the flow control process 300 can determine an adjustment value based upon the comparison of the first and second comparison values, and can subsequently determine a second motor speed 322 (ωsRef) therefrom. As before, the adjustment value and second motor speed 322 can be determined by a controller 320 in various manners. In one example, the controller 320 can comprise a computer program, though it can also comprise a hardware-based controller. As before, in a more specific embodiment, the power controller 320 can include at least one of the group consisting of a proportional (P) controller, an integral (I) controller, a proportional integral (PI) controller, a proportional derivative controller (PD), and a proportional integral derivative (PID) controller, though various other controller configurations are also contemplated to be within the scope of the invention. For the sake of brevity, an example integral-based controller 320 can function similar to the previously described power controller 220 to determine the second motor speed 322, though more or less steps, inputs, outputs, etc. can be included.

Again, as before, the motor controller 304 can use the second motor speed 322 (ωsRef) as an input value and can attempt to drive the pump motor 24, 124 at the new motor speed 322 (ωsRef) until a steady state condition (i.e., synchronous speed) is reached. Further still, as before, the motor controller 304 can insure that the pump motor 24, 124 is running at the speed 322 (ωsRef) provided by the controller 320 because, at a steady state condition, the speed 322 (ωsRef) will be equal to the present motor speed 302 (ωs).

It is to be appreciated that although two example methods of accomplishing flow control have been discussed herein (e.g., flow control based upon a determination of a change in power consumption or a change in flow rate), various other monitored changes or comparisons of the pumping system 10, 110 can also be used independently or in combination. For example, flow control can be accomplished based upon monitored changes and/or comparisons based upon motor speed, flow pressure, filter loading, or the like.

It is also to be appreciated that the flow control process 200, 300 can be configured to interact with (i.e., send or receive information to or from) a second means for controlling the pump. The second means for controlling the pump can include various other elements, such as a separate controller, a manual control system, and/or even a separate program running within the first controller 30, 130. The second means for controlling the pump can provide information for the various variables described above. For example, the information provided can include motor speed, power consumption, flow rate or flow pressure, or any changes therein, or even any changes in additional features cycles of the pumping system 10, 110 or the like. Thus, for example, though the controller 30, 130 has determined a reference flow rate (Qref) based upon parameters such as pool size, turnovers, and motor run time, the determined flow rate can be caused to change due to a variety of factors. In one example, a user could manually increase the flow rate. In another example, a particular water feature (e.g., filter mode, vacuum mode, backwash mode, or the like) could demand a greater flow rate than the reference flow rate. In such a case, the controller 30, 130 can be configured to monitor a total volume of water moved by the pump during a time period (i.e., a 24 hour time period) and to reduce the reference flow rate accordingly if the total volume of water required to be moved (i.e., the required number of turnovers) has been accomplished ahead of schedule. Thus, the flow control process 200, 300 can be configured to receive updated reference flow rates from a variety of sources and to alter operation of the motor 24, 124 in response thereto.

Further still, in accordance with yet another aspect of the invention, a method of controlling the pumping system 10, 110 described herein is provided. The method can include some or all of the aforementioned features of the control process 200, 300, though more or less steps can also be included to accommodate the various other features described herein. In one example method, of controlling the pumping system 10, 110, the method can comprise the steps of determining a first motor speed of the motor, determining a first performance value based upon the first motor speed, determining a second first performance value, and comparing the first performance value to the second performance value. The method can also comprise the steps of determining an adjustment value based upon the comparison of the first and second performance values, determining a second motor speed based upon the adjustment value, and controlling the motor in response to the second motor speed.

It is also to be appreciated that the controller (e.g., 30 or 130) may have various forms to accomplish the desired functions. In one example, the controller 30 can include a computer processor that operates a program. In the alternative, the program may be considered to be an algorithm. The program may be in the form of macros. Further, the program may be changeable, and the controller 30, 130 is thus programmable.

Figure 6:
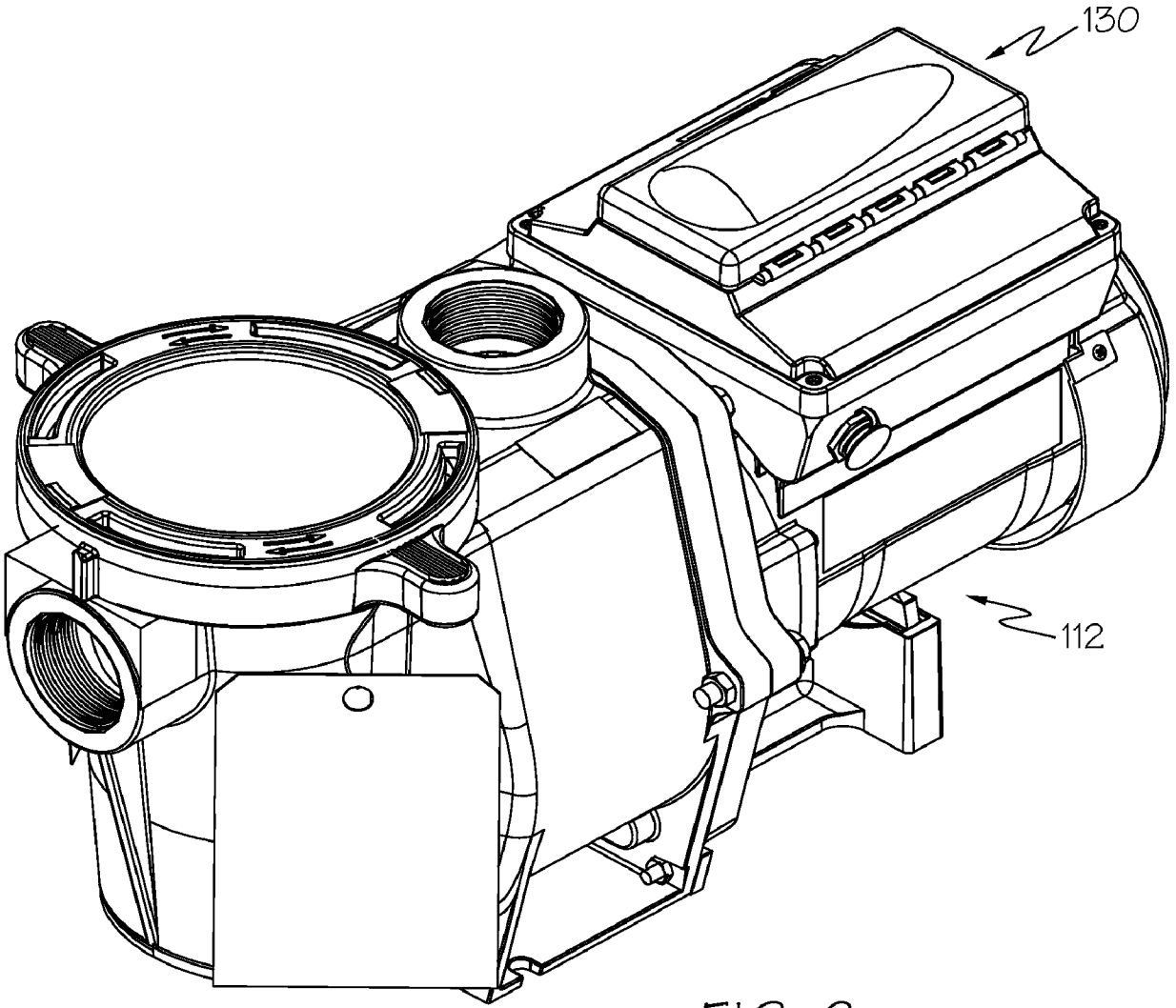
FIG. 6 is a perceptive view of an example pump unit that incorporates the present invention.
Figure 7:
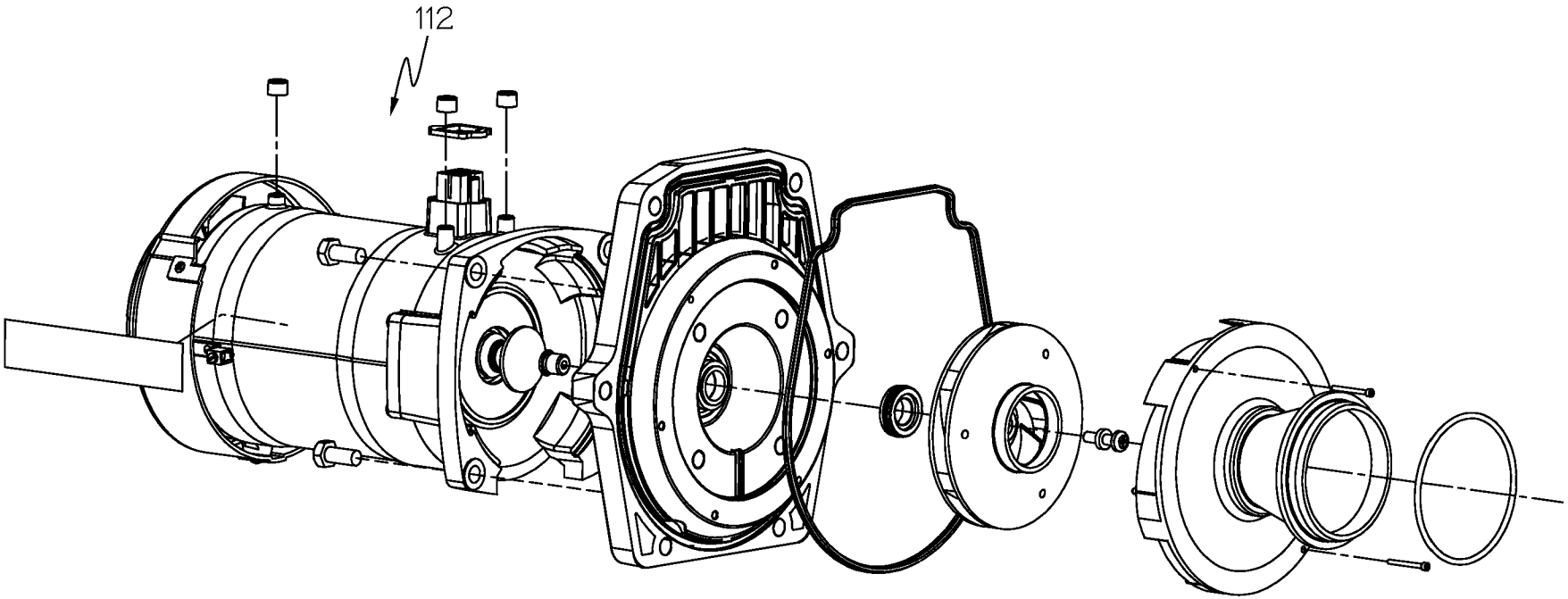
FIG. 7 is a perspective, partially exploded view of a pump of the unit shown in FIG. 6.
Figure 8:
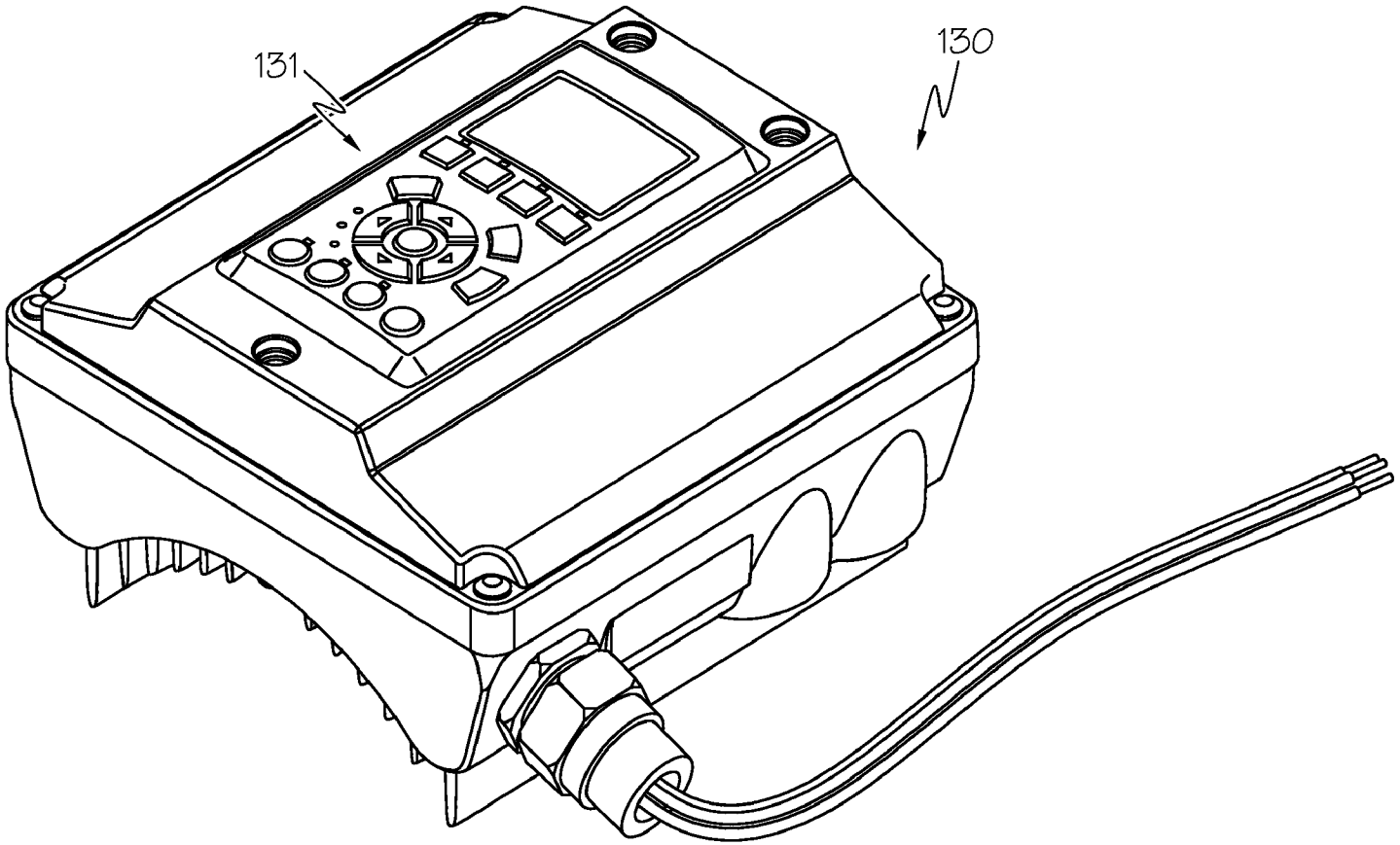
FIG. 8 is a perspective view of a control unit of the pump unit shown in FIG. 6.

Also, it is to be appreciated that the physical appearance of the components of the system (e.g., 10 or 110) may vary. As some examples of the components, attention is directed to FIGS. 6-8. FIG. 6 is a perspective view of the pump unit 112 and the controller 130 for the system 110 shown in FIG. 2. FIG. 7 is an exploded perspective view of some of the components of the pump unit 112. FIG. 8 is a perspective view of the controller 130 and/or user interface 131.

It should be evident that this disclosure is by way of example and that various changes may be made by adding, modifying or eliminating details without departing from the scope of the teaching contained in this disclosure. As such it is to be appreciated that the person of ordinary skill in the art will perceive changes, modifications, and improvements to the example disclosed herein. Such changes, modifications, and improvements are intended to be within the scope of the present invention.

The invention claimed is:

1. A pumping system for at least one aquatic application, the pumping system comprising:

a pump;

a motor coupled to the pump, a controller in communication with the motor, wherein the controller continuously performs a control sequence including:

the controller determining a first motor speed, the controller obtaining a reference flow rate, the controller using a reference estimator to determine a reference power consumption of the motor using the first motor speed, the reference flow rate and predetermined pump curves of power consumption versus motor speed at discrete flow rates included in the reference estimator, the controller determining a present power consumption of the motor, the controller calculating a difference value between the reference power consumption and the present power consumption, the controller using at least one of integral, proportional, proportional-integral, proportional-derivative, and proportional-integral-derivative control to generate a second motor speed based on the difference value, and the controller attempting to drive the motor at the second motor speed until a steady state is reached.

2. The pumping system of claim 1, wherein the first motor speed is determined from a present shaft speed of a synchronous motor.

3. The pumping system of claim 1, wherein the present power consumption is based on at least one of current and voltage provided to the motor.

4. The pumping system of claim 1, wherein the present power consumption is based on at least one of a power factor, resistance, and friction of the motor.

5. The pumping system of claim 1, wherein the difference value is limited to a predetermined range to generate an error value.

6. The pumping system of claim 5, wherein a maximum error value is about 200 watts.

7. The pumping system of claim 5, wherein the error value is multiplied by an integration constant to generate an adjustment value.

8. The pumping system of claim 7, wherein the integration constant is increased when the error value is larger in order to provide larger speed changes and decreased when the error value is smaller in order to provide smaller speed changes.

9. The pumping system of claim 7, wherein the integration constant is increased to increase an iterative process cycle time and decreased to reduce the iterative process cycle time.

10. The pumping system of claim 7, wherein the controller performs a summation calculation to add the adjustment value to a previous motor speed to generate the second motor speed.

11. The pumping system of claim 10, wherein the second motor speed is limited to a maximum value of about 3450 revolutions per minute and a minimum value of about 800 revolutions per minute.

* * * * *